US007636660B2

(12) United States Patent
Hung et al.

(10) Patent No.: US 7,636,660 B2
(45) Date of Patent: Dec. 22, 2009

(54) SUBBAND SYNTHESIS FILTERING PROCESS AND APPARATUS

(75) Inventors: Chih-Wei Hung, Kaohsiung (TW); Chih-Hsien Chang, Hsinchu (TW); Hsien-Ming Tsai, Tainan Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 429 days.

(21) Appl. No.: 11/454,402

(22) Filed: Jun. 15, 2006

(65) Prior Publication Data

US 2007/0156398 A1 Jul. 5, 2007

(30) Foreign Application Priority Data

Jan. 4, 2006 (TW) ..... 95100381 A

(51) Int. Cl.
*G10L 19/00* (2006.01)
*G10L 19/02* (2006.01)

(52) U.S. Cl. ..... 704/229; 704/501

(58) Field of Classification Search ..... 704/500–504, 704/229

See application file for complete search history.

(56) References Cited

U.S. PATENT DOCUMENTS 5,285,498 A * 2/1994 Johnston ..... 381/2
5,481,614 A * 1/1996 Johnston ..... 381/2
5,657,423 A * 8/1997 Benbassat et al. ..... 704/230
6,657,567 B2 * 12/2003 Koyanagi ..... 341/60
6,885,993 B2 * 4/2005 Wu et al. ..... 704/500
6,925,116 B2 * 8/2005 Liljeryd et al. ..... 375/240
6,965,859 B2 * 11/2005 Kolesnik et al. ..... 704/200.1
7,069,212 B2 * 6/2006 Tanaka et al. ..... 704/225

* cited by examiner

*Primary Examiner*—Michael N Opsasnick
(74) *Attorney, Agent, or Firm*—Stites & Harbison PLLC; Juan Carlos A. Marquez, Esq.

(57) ABSTRACT

A subband synthesis filtering apparatus for M sets of signals is provided. Each set of signals includes N subband sample signals. The apparatus includes a processor for processing the ith set of signals among the M sets of signals, wherein i is an integer index ranging from 0 to (M−1). The processor includes a DCT converting module and a generating module. The DCT converting module converts the N subband sample signals of the ith set of signals into N converted vectors. If i is an odd number, the (2j−1)th subband sample signal among the N subband sample signals is multiplied by negative one in the converting module, wherein j is an integer index ranging from 1 to (N/2). The generating module generates N pulse code modulation signals based on the N converted vectors.

8 Claims, 6 Drawing Sheets

SUBBAND SYNTHESIS FILTERING PROCESS AND APPARATUS

BACKGROUND OF THE INVENTION

1. Field of the Invention

The present invention relates to apparatuses and methods for subband synthesis filtering and, in particular, to the apparatuses and methods used in audio decoders.

2. Description of the Prior Art

The Motion Pictures Experts Group (MPEG) audio signal specification provides standard encoding/decoding algorithms for audio signals. The algorithms in the MPEG specification can significantly reduce bandwidth demands for transmitting audio data and can also provide audio signals with little distortions. Currently, the encoding/decoding algorithms in the MPEG audio signal specification are mainly divided as three layers: Layer I, Layer II, and Layer III.

Please refer to FIG. 1, which illustrates the flowchart of decoding an audio frame according to the MPEG-1 Layer III (MP3) algorithm. In Step S11, a header of the audio frame is unpacked, and the side information of the audio frame is decoded. Next, in step S12, audio data compressed with Huffman encoding method in the audio frame is decoded, and re-quantization is performed on the frequency components generated after Huffman decoding. In Step S13, joint stereo processing is performed on the frequency components according to audio modes recorded in the side information. In Step S14, alias reduction is performed on the frequency components. In Step S15, inverse modified discrete cosine transform (IMDCT) is performed on the frequency components. In Step S16, frequency inversion is performed on the sample signals generated after IMDCT. In Step S17, subband synthesis filtering is performed to synthesize pulse code modulation (PCM) signals based on the sample signals. At last, step S18 is executed to output the PCM signals, so as to complete this decoding procedure of the audio frame.

In the MP3 standards, there are 576 sample signals generated after IMDCT in step S15. The 576 sample signals include sample signals of 32 subbands; each subband respectively corresponds to 18 sample signals. Assume the 32 subbands are respectively numbered as the 0th subband, the 1st subband . . . , and the 31st subband, and the 18 sample signals in one subband are respectively numbered as the 0th sample signal, the 1st sample signal . . . , and the 17th sample signal. In the frequency inversion in step S16, the 1st, 3rd . . . , and 17th sample signals in the 1st, 3rd, . . . , and 31st subbands are respectively multiplied by negative one, that is, multiplying the odd numbered sample signals in the odd numbered subbands by negative one.

Please refer to FIG. 2, which illustrates the flowchart of the process of the frequency inversion in prior arts. This procedure starts at step S20. In Step S21, sample signals corresponding to a certain subband among the 32 subbands are accessed. In Step S22, this subband is being judged whether it is an odd subband among the 32 subbands. If the judging result of step S22 is YES, step S23 is performed; otherwise, step S27 is then performed. In Step S23, one of the 18 sample signals of this subband is accessed. In Step S24, the sample signal accessed in step S23 is being judged whether it is an odd sample signal among the 18 sample signals of this subband. If the judging result of step S24 is YES, step S25 is performed; otherwise, step S26 is then performed. In Step S25, the sample signal accessed in step S23 is multiplied by negative one. In Step S26, it is judged whether all the 18 sample signals in this subband have been accessed. If the judging result of step S26 is YES, step S27 is performed; otherwise, step S23 is performed again. In Step S27, it is judged whether all the 32 subbands have been accessed. If the judging result of step S27 is YES, step S28 is performed to end this procedure; otherwise, step S21 is performed again.

As shown in FIG. 2, the frequency inversion procedure in prior arts includes numerous accessing and judging steps. These steps take up a lot of processing time and accordingly decrease the efficiency of decoding the MP3 audio frames.

Subband synthesis filtering, the step next to frequency inversion, is generating PCM signals based on subband sample signals after frequency inversion. There have been prior arts for converting 32 sample signals into 32 converted vectors by 32-point discrete cosine transform (DCT).

Please refer to FIG. 3, which illustrates the flowchart of a subband synthesis filtering procedure using 32-point DCT in the prior art. In this procedure, the 576 sample signals generated after frequency inversion are divided into 18 sets of signals. Each set of the signals respectively includes 32 sample signals; each of the 32 sample signals corresponds to a respective subband. The 18 sets of signals are sequentially processed. In Step S31, the 32 sample signals being processed are inputted into the procedure or apparatus of subband synthesis filtering. Next, in step S32, the 32 sample signals are converted into 32 converted vectors. In Step S33, 32 PCM signals are generated based on the 32 converted vectors.

SUMMARY OF THE INVENTION

One main purpose of this invention is providing subband synthesis filtering apparatuses and methods. The apparatuses and methods, according to this invention, integrate frequency inversion into subband synthesis filtering procedures; thus, the efficiency of decoding MP3 audio frames can be substantially raised. More specifically, the apparatuses and methods, according to this invention, integrate frequency inversion with methods of generating converted vectors by DCT.

One preferred embodiment, according to this invention, is a subband synthesis filtering apparatus for M sets of signals. Each set of signals includes N subband sample signals. The subband synthesis filtering apparatus includes a processor for processing the ith set of signals among the M sets of signals, wherein i is an integer index ranging from 0 to (M−1). The processor further includes a DCT module and a generating module. The DCT module is used for converting the N subband sample signals of the ith set of signals into N converted vectors based on a DCT. If i is an odd number, the (2j−1)th subband sample signal among the N subband sample signals is multiplied by negative one by the DCT module during the process of generating N converted vectors, wherein j is an integer index ranging from 1 to (N/2). The generating module is used for generating N pulse code modulation (PCM) signals based on the N converted vectors.

For instance, if the M sets of signals are subband sample signals which have gone through IMDCT in accordance with the MP3 standard, then M is equal to 18, and N is equal to 32.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
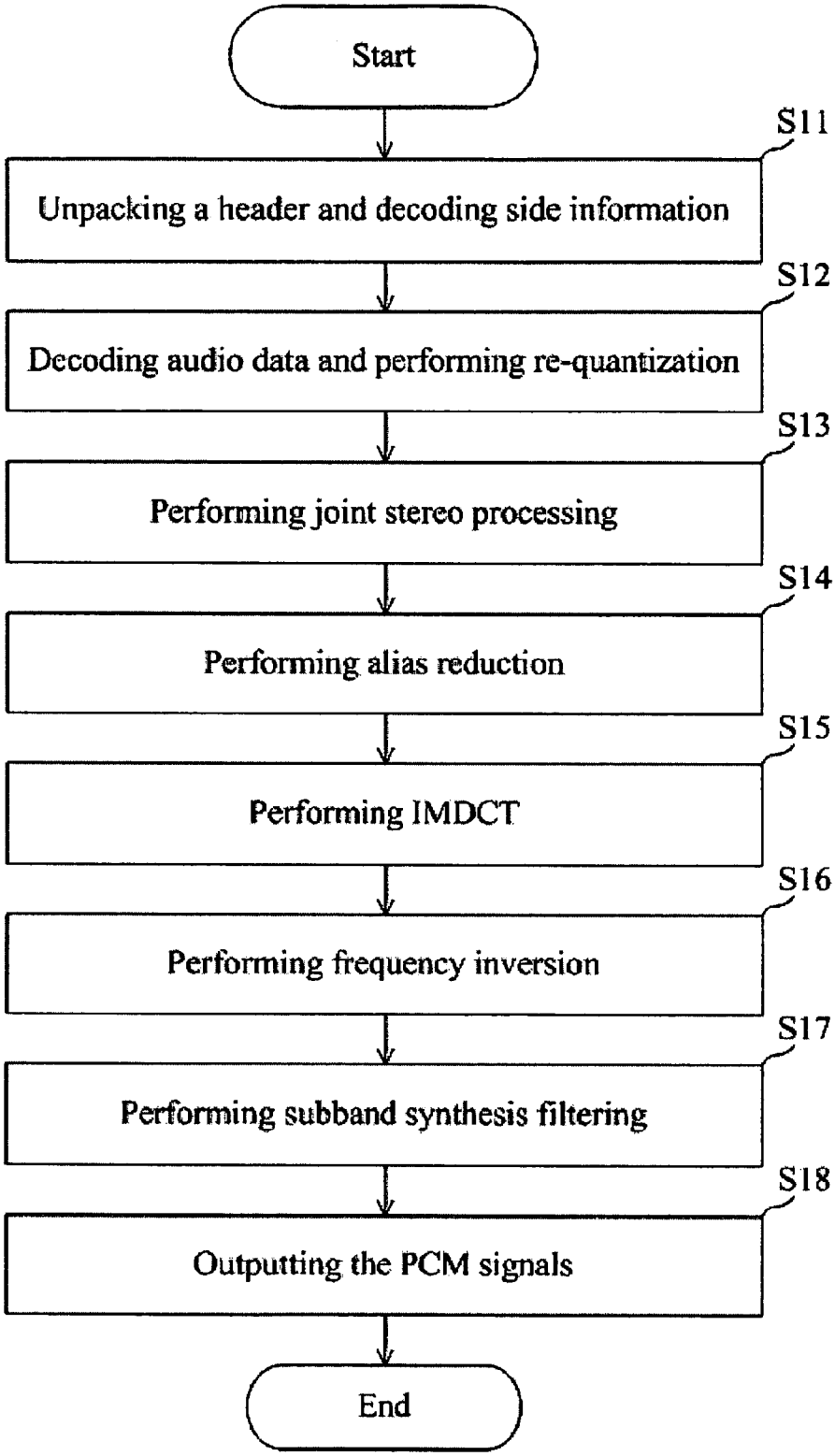
FIG. 1 (Prior art)
FIG. 1 illustrates the flowchart of decoding an audio frame according to the MP3 algorithm in the prior art.
Figure 2:
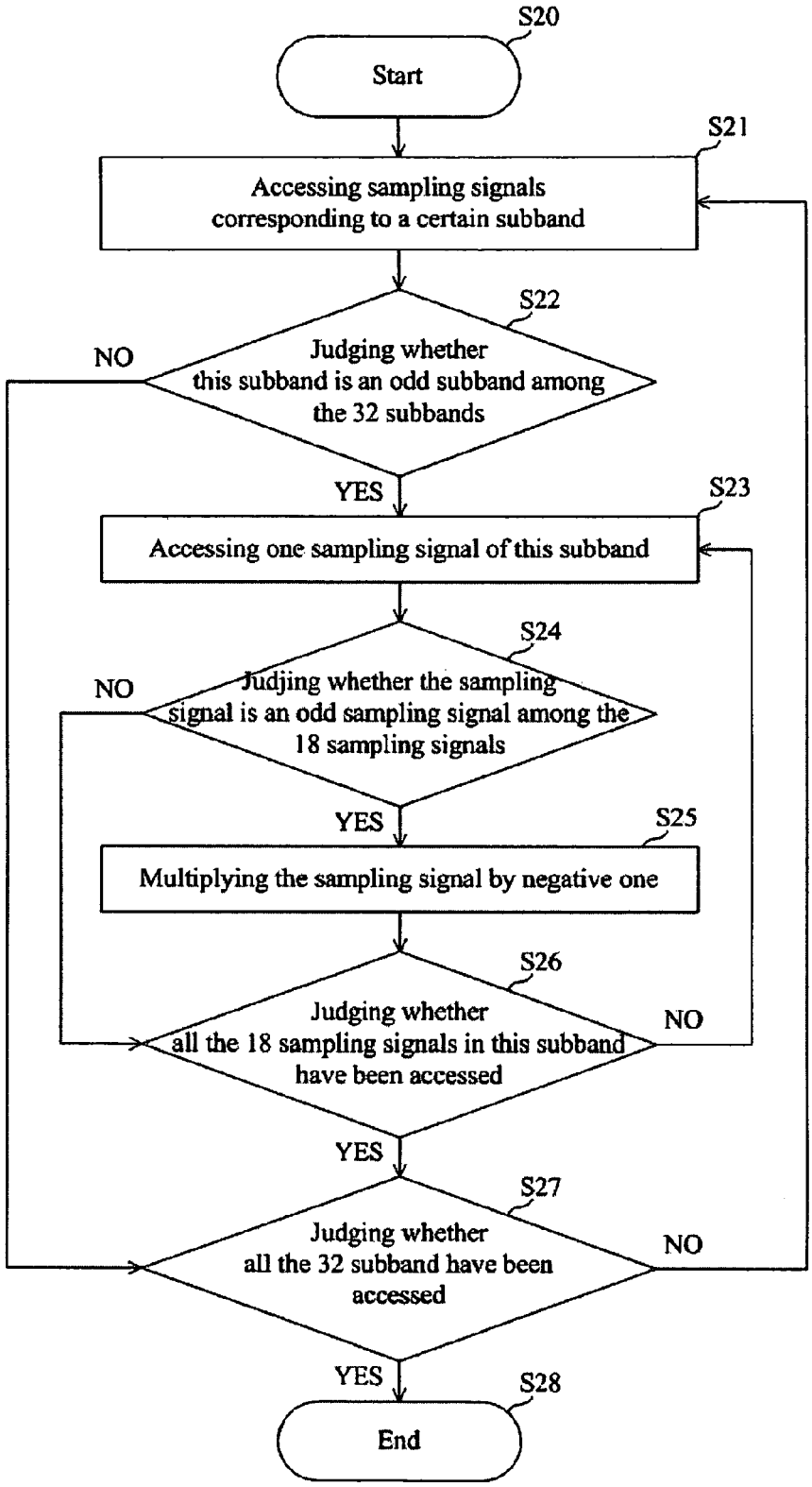
FIG. 2 (Prior art)
FIG. 2 illustrates the flowchart of frequency inversion in prior arts.
Figure 3:
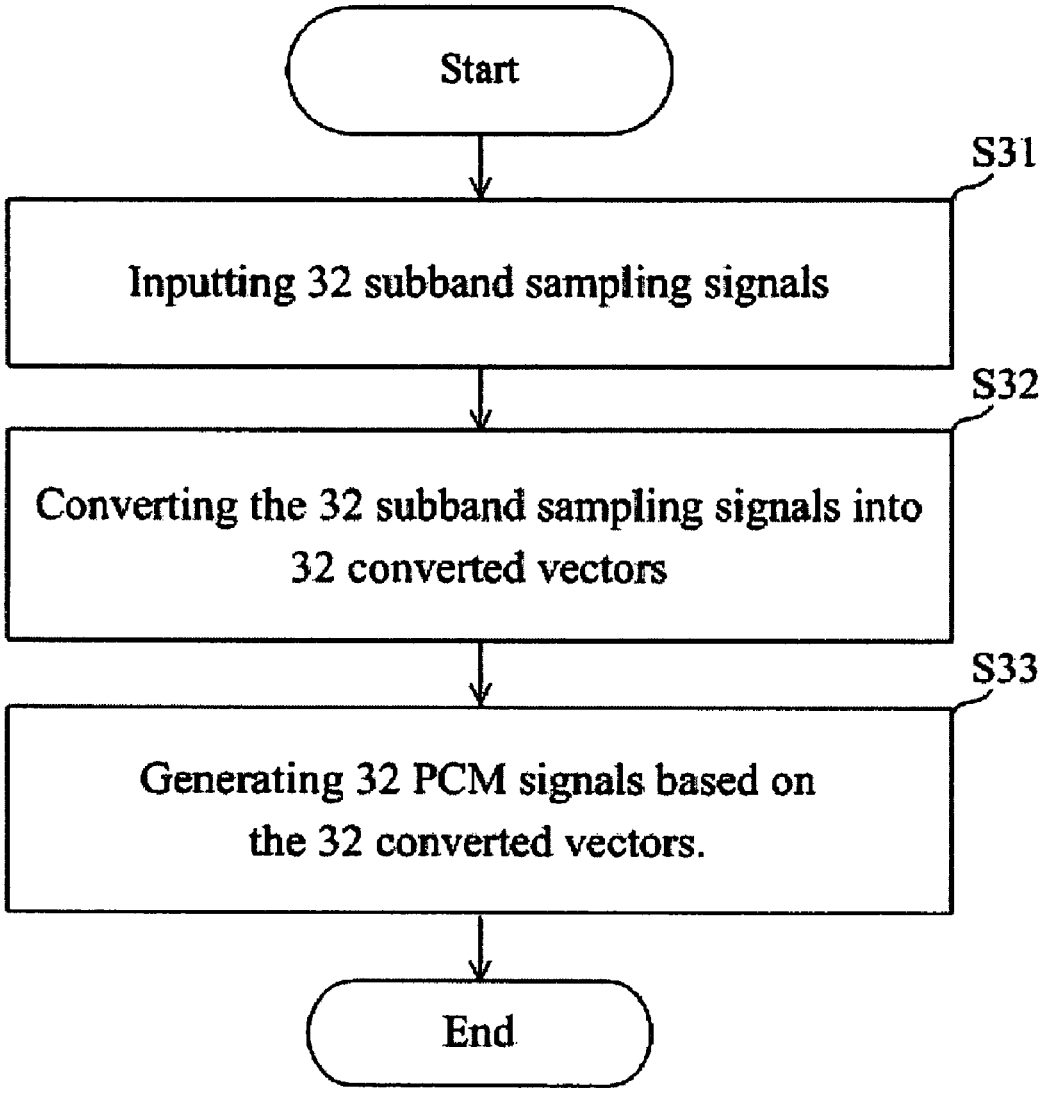
FIG. 3 (Prior art)
FIG. 3 illustrates the flowchart of a subband synthesis filtering procedure using 32-point DCT in the prior art.

One main purpose of this invention is to provide subband synthesis filtering apparatuses and methods. The apparatuses and methods, according to this invention, integrate frequency inversion of the prior art into subband synthesis filtering procedures; thus, the efficiency of decoding MP3 audio frames can be substantially raised. Please refer to FIG. 4, which illustrates the block diagram of a subband synthesis filtering apparatus 40 in one preferred embodiment according to this invention. The subband synthesis filtering apparatus 40 operates on M sets of signals in which each comprises N subband sample signals S4A. M and N are both positive integers. For instance, if the M sets of signals are subband sample signals which have gone through IMDCT in accordance with the MPEG-1 Layer III standard, then M is equal to 18 and N is equal to 32. As mentioned above, the 576 sample signals generated after IMDCT and frequency inversion can be divided into 18 sets of signals. Each set of the signals respectively includes 32 sample signals; each of the 32 sample signals corresponds to a respective subband.

Figure 4:
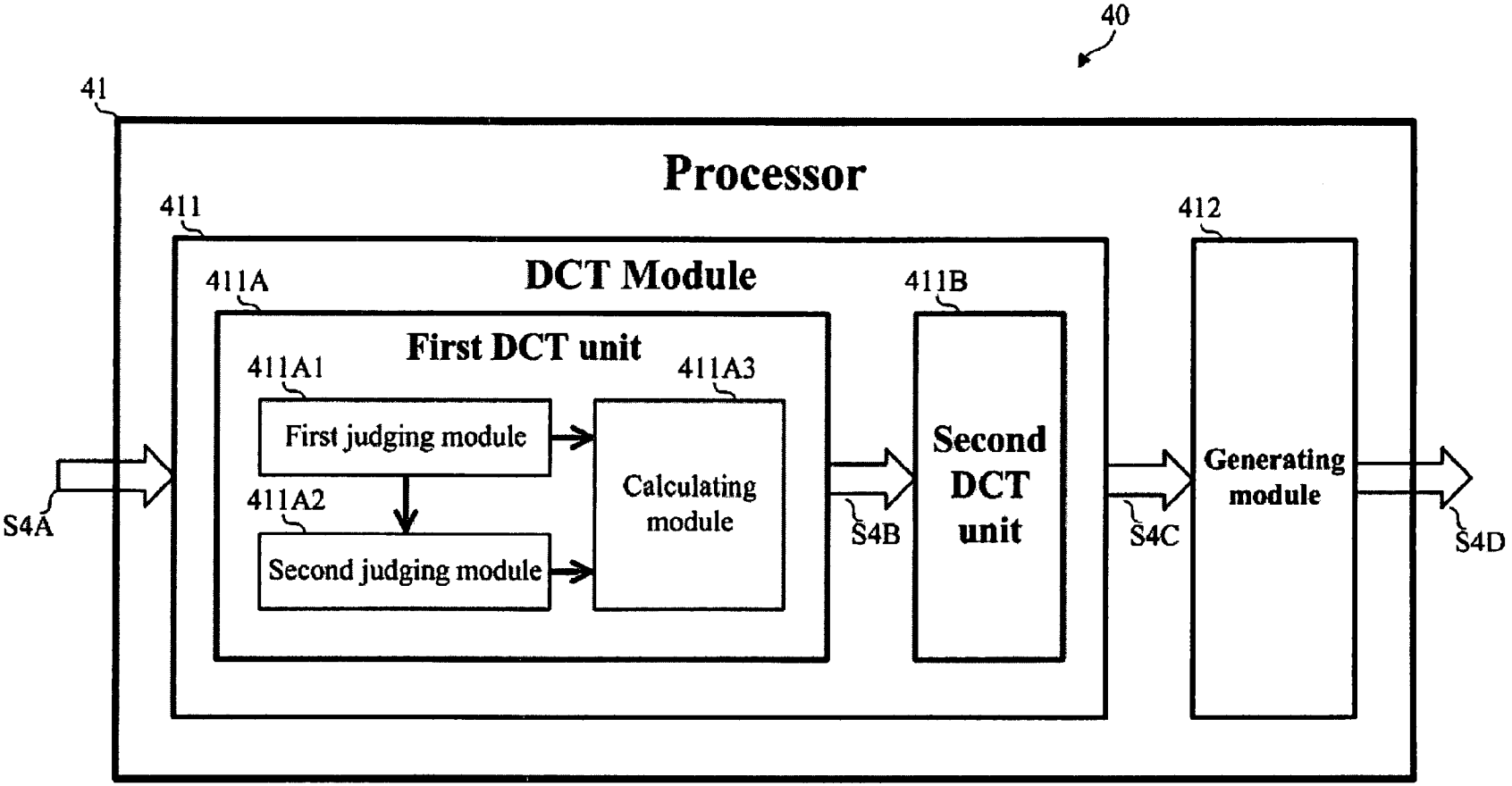
FIG. 4 illustrates the block diagram of a subband synthesis filtering apparatus in one preferred embodiment according to this invention.

The subband synthesis filtering apparatus 40 includes a processor 41. The processor 41 is used for processing the ith set of signals among the M sets of signals, wherein i is an integer index ranging from 0 to (M−1). As shown in FIG. 4, the processor 41 further includes a discrete cosine transform (DCT) module 411 and a generating module 412. The DCT module 411 is used for converting the N subband sample signals S4A of the ith set of signals into N converted vectors S4C based on DCT. If i is an odd number, during the procedure of generating the N converted vectors S4C, the odd subband sample signals among the N subband sample signals S4A are multiplied by negative one respectively. That is to say, the DCT module 411 multiplies the (2j−1)th subband sample signal among the N subband sample signals S4A by negative one, wherein j is an integer index ranging from 1 to (N/2). The generating module is used for generating N pulse code modulation (PCM) signals S4D based on the N converted vectors S4C.

Using the audio signals of MPEG-1 Layer III as an example, because directly converting 32 subband sample signals into 32 converted signals is too complicated, a 32-point DCT can be separated into eight 4-point DCTs by decomposition and recursion, so as to simplify calculations. As known by those skilled in this art, the equation of 32-point DCT can be represented as:

$$X(n) = \sum_{k=0}^{31} x(k) C_{64}^{(2k+1)n} \quad \text{for } n = 0, 1, \ldots, 31, \qquad \text{(Equation 1)}$$

wherein x(k) and X(n) are input signals and output signals of the 32-point DCT, respectively. The kth subband sample signal among the 32 subband sample signals of the ith set of signals is represented as x(k−1), wherein k is an integer index ranging from 1 to 32 and $$C_{64}^{(2k+1)n} = \cos\left(\frac{n\pi(2k+1)}{64}\right).$$

X(n) in Equation 1 can be decomposed into two 16-point DCTs, F1(n) and F2(n):

$$X(2n) = F1(n) \quad \text{for } n = 0, 1, \ldots, 15 \qquad \text{(Equation 2)}$$
$$X(2n+1) = F2(n) + F2(n+1) \quad \text{for } n = 0, 1, \ldots, 15,$$

wherein, $$F1(n) = \sum_{k=0}^{15} f1(k) C_{32}^{(2k+1)n} \quad \text{for } n = 0, 1, \ldots, 15 \qquad \text{(Equation 3)}$$
$$F2(n) = \sum_{k=0}^{15} f2(k) C_{32}^{(2k+1)n} \quad \text{for } n = 0, 1, \ldots, 15,$$

wherein, $$f1(k) = x(k) + x(31-k) \quad \text{for } k = 0, 1, \ldots, 15 \qquad \text{(Equation 4)}$$
$$f2(k) = \left(\frac{1}{2} C_{64}^{(2k+1)}\right)[x(k) - x(31-k)]$$
$$\text{for } k = 0, 1, \ldots, 15 \text{ and}$$
$$C_{32}^{(2k+1)n} = \cos\left(\frac{n\pi(2k+1)}{32}\right).$$

F1(n) of the 16-point DCT in Equation 3 can be further decomposed into two 8-point DCTs, G1(n) and G2(n):

$$F1(2n) = G1(n) \quad \text{for } n = 0, 1, \ldots, 7 \qquad \text{(Equation 5)}$$
$$F1(2n+1) = G2(n) + G2(n+1)$$
$$\text{for } n = 0, 1, \ldots, 7, \text{ wherein,}$$

$$G1(n) = \sum_{k=0}^{7} g1(k) C_{16}^{(2k+1)n} \quad \text{for } n = 0, 1, \ldots, 7 \qquad \text{(Equation 6)}$$
$$G2(n) = \sum_{k=0}^{7} g1(k) C_{16}^{(2k+1)n} \quad \text{for } n = 0, 1, \ldots, 7$$
$$G2(n) = \sum_{k=0}^{7} g2(k) C_{16}^{(2k+1)n} \quad \text{for } n = 0, 1, \ldots, 7,$$

wherein, $$g1(k) = f1(k) + f1(15-k) \quad \text{for } k = 0, 1, \ldots, 7 \qquad \text{(Equation 7)}$$
$$g2(k) = \left(\frac{1}{2} C_{32}^{(2k+1)}\right)[f1(k) - f1(15-k)]$$
$$\text{for } k = 0, 1, \ldots, 7, \text{ and}$$
$$C_{16}^{(2k+1)n} = \cos\left(\frac{n\pi(2k+1)}{16}\right).$$

F2(n) of the 16-point DCT in Equation 3 can also be further decomposed into two 8-point DCTs, G3(n) and G4(n):

$$F2(2n) = G3(n) \quad \text{for } n = 0, 1, \ldots 7 \qquad \text{(Equation 8)}$$
$$F2(2n+1) = G4(n) + G4(n+1) \quad \text{for } n = 0, 1, \ldots, 7,$$

wherein,

-continued $$G3(n) = \sum_{k=0}^{7} g3(k) C_{16}^{(2k+1)n} \text{ for } n = 0, 1, \ldots, 7 \quad \text{(Equation 9)}$$

$$G4(n) = \sum_{k=0}^{7} g4(k) C_{16}^{(2k+1)n} \text{ for } n = 0, 1, \ldots, 7,$$

wherein, $$g3(k) = f2(k) + f2(15-k) \text{ for } k = 0, 1, \ldots, 7 \quad \text{(Equation 10)}$$

$$g4(k) = \left(\frac{1}{2} C_{32}^{(2k+1)}\right)[f2(k) - f2(15-k)] \text{ for } k = 0, 1, \ldots 7.$$

Similarly, the four 8-point DCTs of equation 5 and equation 8 can be respectively decomposed into two 4-point DCTs. Accordingly, the 32-point DCT in Equation 1 can be decomposed into eight 4-point DCTs in the end.

Based on Equations 4, 7, and 10, the relationship between the four results of 8-point DCTs and the input signal x of the 32-point DCT can be summarized as:

$$g1(p) = x(p) + x(31-p) + x(15-p) + x(16+p) \quad \text{(Equation 11)}$$

$$g2(p) = \left(\frac{1}{2} C_{32}^{(2p+1)}\right)[x(p) + x(31-p) - x(15-p) - x(16+p)]$$

$$g3(p) = \left(\frac{1}{2} C_{64}^{(2p+1)}\right)[x(p) - x(31-p)] + \left(\frac{1}{2} C_{64}^{(31-2p)}\right)[x(15-p) - x(16+p)]$$

$$g4(p) = \left(\frac{1}{2} C_{32}^{(2p+1)}\right)\left\{\left(\frac{1}{2} C_{64}^{(2p+1)}\right)[x(p) - x(31-p)] - \left(\frac{1}{2} C_{64}^{(31-2p)}\right)[x(15-p) - x(16+p)]\right\},$$

wherein p is an integer index ranging from 0 to 7.

In this invention, the procedure of a 32-point DCT is divided into three stages, and frequency inversion is integrated into the first stage. As shown in FIG. 4, the DCT module 411 includes a first DCT unit 411A and a second DCT unit 411B.

In the first stage, the 32-point DCT is firstly decomposed into two 16-point DCTs. Next, each of the 16-point DCTs is further decomposed into two 8-point DCTs. The results of the 8-point DCTs are called intermediate results here. As shown in FIG. 4, in the first DCT unit 411A, the 32 subband sample signals are divided into eight groups; each group respectively includes four subband sample signals: x(p), x(31−p), x(15−p), and x(16+p), wherein p is an integer index ranging from 0 to 7. The first DCT unit 411A includes a first judging module 411A1, a second judging module 411A2, and a calculating module 411A3. In actual application, the first DCT unit 411A1 can process the eight groups of signals sequentially or simultaneously.

The first judging module 411A1 is used for judging whether i is an odd number. That is to say, the first judging module 411A1 judges whether the set of subband sample signals being processed is an odd one among the 18 sets of subband sample signals.

The second judging module 411A2 is operated by the first judging module 411A1. If the judging result of the first judging module 411A1 is NO, the second judging module 411A2 will not be operated. On the contrary, if the judging result of the first judging module 411A1 is YES, the second judging module 411A2 then judges whether x(p), x(31−p), x(15−p) and x(16+p) correspond to an odd number p. The calculating module 411A3 is operated by both the first judging module 411A1 and the second judging module 411A2. If the judging result of the first judging module 411A1 is NO, meaning the set of subband sample signals being processed is an even one among the 18 sets of subband sample signals, this set of subband sample signals will not be multiplied by negative one according to the rules of frequency inversion in the MP3 standard. This situation is equivalent to that when frequency inversion is not integrated with DCT. Therefore, the calculating module 411A3 calculates four intermediate results (g1(p), g2(p), g3(p), and g4(p)) corresponding to p based on Equation 11. If the judging result of the first judging module 411A1 is YES, the set of subband sample signals being processed is an odd one among the 18 sets of subband sample signals. According to the rules of frequency inversion in the MP3 standard, this set of subband sample signals must be multiplied by negative one. Subsequently, the second judging module 411A2 further judges whether p is an odd number. If p is an even number, then x(31−p) and x(15−p) are odd ones among the 32 subband sample signals. For instance, if p is equal to 2, x(31−p) and x(15−p) are x(29) and x(13), respectively; both 29 and 13 are odd numbers. On the contrary, if p is an odd number, then x(p) and x(16+p) are odd ones among the 32 subband sample signals. For instance, if p is equal to 1, x(p) and x(16+p) are x(1) and x(17), respectively; both 1 and 17 are odd numbers. Accordingly, if the judging result of the second judging module 411A2 is NO, the calculating module 411A3 respectively multiplies x(31−p) and x(15−p) by negative one when calculating the intermediate results. If the judging result of the second judging module 411A2 is YES, the calculating module 411A3 respectively multiplies x(p) and x(16+p) by negative one when calculating the intermediate results.

To summarize the descriptions above, if the judging result of the second judging module 411A2 is NO, the calculating module 411A3 calculates four intermediate results (g1(p), g2(p), g3(p), and g4(p)) based on the following equations:

$$g1(p) = x(p) - x(31-p) - x(15-p) + x(16+p) \quad \text{(Equation 12)}$$

$$g2(p) = \left(\frac{1}{2} C_{32}^{(2p+1)}\right)[x(p) - x(31-p) + x(15-p) - x(16+p)]$$

$$g3(p) = \left(\frac{1}{2} C_{64}^{(2p+1)}\right)[x(p) + x(31-p)] - \left(\frac{1}{2} C_{64}^{(31-2p)}\right)[x(15-p) + x(16+p)]$$

$$g4(p) = \left(\frac{1}{2} C_{32}^{(2p+1)}\right)\left\{\left(\frac{1}{2} C_{64}^{(2p+1)}\right)[x(p) + x(31-p)] + \left(\frac{1}{2} C_{64}^{(31-2p)}\right)[x(15-p) + x(16+p)]\right\}.$$

If the judging result of the second judging module 411A2 is YES, the calculating module 411A3 calculates g1(p), g2(p), g3(p), and g4(p) based on the following equations:

$$g1(p) = -x(p) + x(31-p) + x(15-p) - x(16+p) \quad \text{(Equation 13)}$$

$$g2(p) =$$

-continued $$\left(\frac{1}{2}C_{32}^{(2p+1)}\right)[-x(p)+x(31-p)-x(15-p)+x(16+p)]$$

$$g3(p)=\left(\frac{1}{2}C_{64}^{(2p+1)}\right)[-x(p)-x(31-p)]+\left(\frac{1}{2}C_{64}^{(31-2p)}\right)[x(15-p)+x(16+p)]$$

$$g4(p)=\left(\frac{1}{2}C_{32}^{(2p+1)}\right)\left\{\left(\frac{1}{2}C_{64}^{(2p+1)}\right)[-x(p)-x(31-p)]-\left(\frac{1}{2}C_{64}^{(31-2p)}\right)[x(15-p)+x(16+p)]\right\}.$$

As shown in Equations 12 and 13, in the calculating module 411A3, frequency inversion is integrated with the procedure of calculating intermediate results of 8-point DCTs according to the subband synthesis filtering apparatus 40 of the present invention. In this way, the efficiency of decoding MP3 audio frames can be substantially raised.

Taking an actual situation as an example, assume the first judging module 411A1 is processing the subband sample signals x(0), x(31), x(15), x(16) in the 1st set of signals, wherein i is equal to 1, and p is equal to 0. Because i is an odd number, the judging result of the first judging module 411A1 is YES. Next, the second judging module 411A2 judges whether x(0), x(31), x(15), x(16) correspond to an odd p. Because p is an even number, the judging result of the second judging module 411A2 is NO. Therefore, the calculating module 411A3 calculates the intermediate results (g1(0), g2(0), g3(0), and g4(0)) respectively corresponding to x(0), x(31), x(15), x(16) based on Equation 12. Setting p=0 in Equation 12 can derive the following equations:

$$g1(0)=x(0)-x(31)-x(15)+x(16) \qquad \text{(Equation 14)}$$

$$g2(0)=\left(\frac{1}{2}C_{32}^{1}\right)[x(0)-x(31)+x(15)-x(16)]$$

$$g3(0)=\left(\frac{1}{2}C_{64}^{1}\right)[x(0)+x(31)]-\left(\frac{1}{2}C_{64}^{31}\right)[x(15)+x(16)]$$

$$g4(0)=\left(\frac{1}{2}C_{32}^{1}\right)\left\{\left(\frac{1}{2}C_{64}^{1}\right)[x(0)+x(31)]+\left(\frac{1}{2}C_{64}^{31}\right)[x(15)+x(16)]\right\}.$$

Because of being odd subband sample signals, x(31) and x(15) in Equation 14 are respectively multiplied by negative one as compared with those in Equation 11 that does not include any frequency inversion.

When sequentially processing the eight groups of subband sample signals, the calculating module 411A3 generates four intermediate results (g1(p), g2(p), g3(p) and g4(p)) each time. Therefore, after processing the eight groups, 32 intermediate results (g1(0)~g1(7), g2(0)~g2(7), g3(0)~g3(7), g4(0)~g4(7)) are generated.

Figure 5:
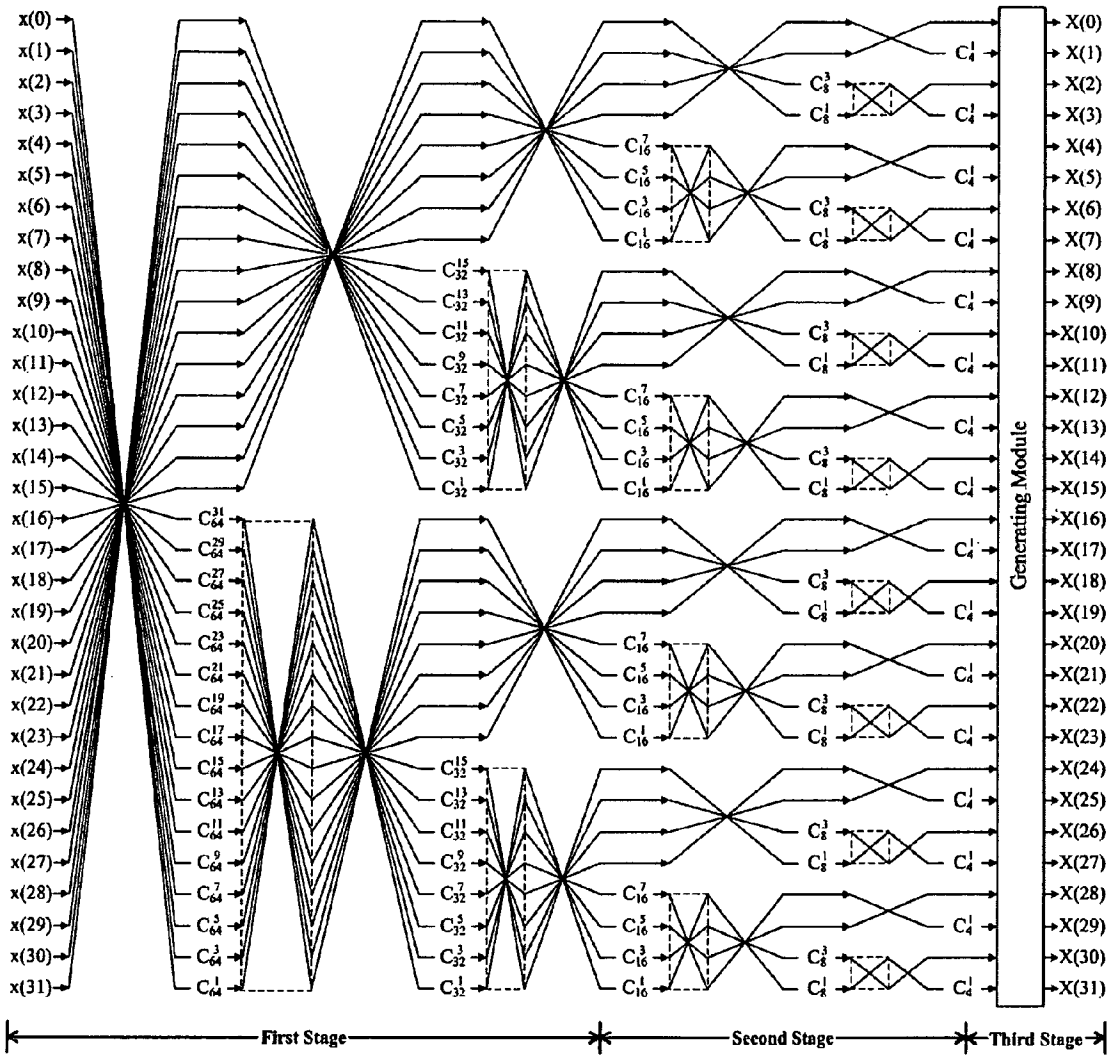
FIG. 5 illustrates the idea of integrating frequency inversion and subband synthesis filtering according to this invention.

As shown in FIG. 5, each 8-point DCT are further divided into two 4-point DCTs, and 32 converted vectors based the intermediate results are generated in the second stage. In FIG. 4, the second DCT unit 411B divides the four 8-point DCTs of Equations 5 and 8 into eight 4-point DCTs. According to the 32 intermediate results generated by the calculating module 411A3, the second DCT unit 411B can generate 32 converted vectors with the eight 4-point DCTs.

The third stage in FIG. 5 is for synthesizing the 32 converted vectors into 3 PCM signals. As shown in FIG. 4, the generating module 412 of the processor 41 generates 32 PCM signals based on the 32 converted vectors generated by the second DCT unit 411B.

Please refer to FIG. 5, which illustrates the idea of integrating frequency inversion and subband synthesis filtering in this invention. The first stage represents the operation of the first DCT unit 411A; the second stage represents the operation of the second DCT unit 411B, and the third stage represents the operation of the generating module 412. The crossed lines represent adding or subtracting between signals. $C_Y^X$ in FIG. 5 represents the operation of (½)*$C_Y^X$ in the equations above. As shown in FIG. 5, the 32 subband sample signals are converted to 8 sets of intermediate results in the first stage. Each set of the intermediate results respectively includes four 8-point DCT results. The frequency inversion procedure is integrated in the first stage. In the second stage, the second DCT unit 411B generates 32 converted vectors with DCT based on the 32 intermediate results calculated by the first DCT unit 411A. Subsequently, in the third stage, the generating module 412 generates 32 PCM signals based on the 32 converted vectors.

Figure 6:
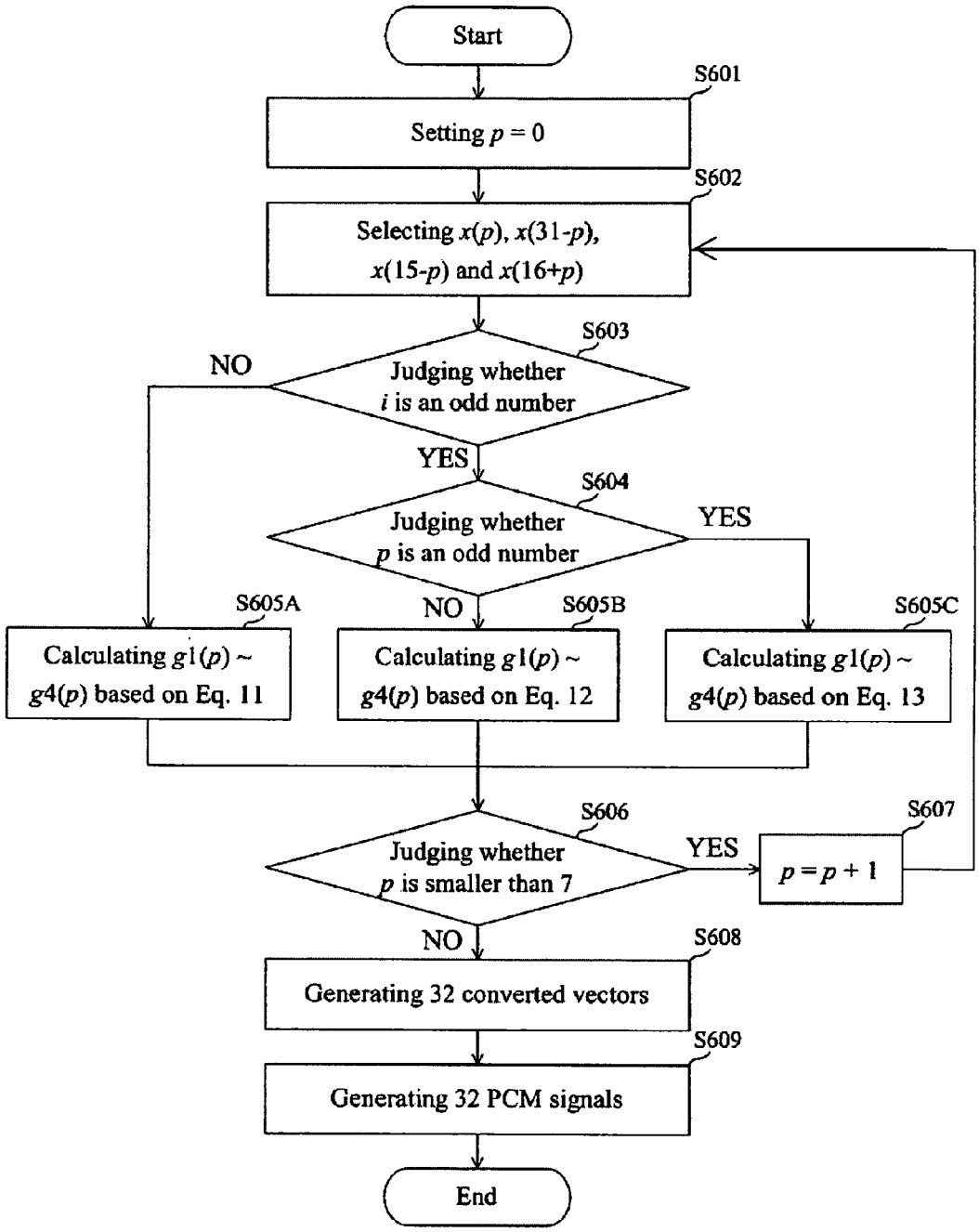
FIG. 6 illustrates the flowchart of a subband synthesis filtering method in one preferred embodiment according to this invention.

Please refer to FIG. 6, which illustrates the flowchart of a subband synthesis filtering method in one preferred embodiment according to this invention. The method sequentially processes the 18 sets of subband sample signals, wherein i is an integer index ranging from 0 to 17. When the ith set of signals is processed, the step S601 is first performed to set an integer index p equal to 0. Step S602 is then performed to select x(p), x(31−p), x(15−p), and x(16+p) from the ith set of signals. Step S603 then judges whether i is an odd number. If the judging result of step S603 is NO, step S605A is then performed to calculate g1(p), g2(p), g3(p), and g4(p) according to Equation 11. If the judging result of step S603 is YES, step S604 is performed to judge whether p is an odd number. If the judging result of step S604 is NO, step S605B is then performed to calculate g1(p), g2(p), g3(p), and g4(p) according to Equation 12. If the judging result of step S604 is YES, step S605C is then performed to calculate g1(p), g2(), g3(p), and g4(p) according to Equation 13. After steps S605A, S605B, or S605C, step S606 is performed to judge whether p is smaller than seven. In other words, step S606 is for judging whether all the 32 subband sample signals in the ith set of signals have been processed. If the judging result of step S606 is YES, step S607 is then performed to set p=p+1, and steps S602 through S606 are repeated. If the judging result of step S606 is NO, all the 32 subband sample signals in the ith set of signals have been processed. Subsequently, steps S608 and S609 are performed. Step S608 is for calculating eight 4-point DCT results based on g1(0)~g1(7), g2(0)~g2(7), g3(0)~g3(7) and g4(0)~g4(7). The eight 4-point DCT results are used to generate 32 converted vectors in step S608. Step S609 then generates 32 PCM signals based on the 32 converted vectors.

In the embodiments, according to this invention, a 32-point DCT is divided into three stages. The first stage converts the 32 subband sample signals into 8 sets of intermediate results. Frequency inversion is also integrated in the first stage. The second stage generates 32 converted vectors based on the intermediate results. The third stage is for converting the 32 converted vectors into 32 PCM signals. Because parts of the 32-point DCT calculation can share the same coefficients, the frequency of accessing memories can be reduced and accordingly raise calculation speeds. The simpler calculating procedures can also reduce the frequency of storing the results of frequency inversion into memory and of reading the results of frequency inversion from memories; thus, calculation speeds can be further increased. Furthermore, integrating frequency inversion with the first stage of the 32-point DCT can reduce the size of a corresponding computer program compared with prior arts using double-loop calculation in frequency inversion. In actual application, embodiments according to this invention can also integrate frequency inversion with a 32-point DCT, two 16-point DCTs, or four 8-point DCTs, instead of eight 4-point DCTs.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A subband synthesis filtering apparatus for M sets of signals which each comprises N subband sample signals, M and N being both positive integers, said apparatus comprising:

a processor for processing the ith set of signals among the M sets of signals, wherein i is an integer index ranging from 0 to (M−1), the processor comprising:

a discrete cosine transform (DCT) module for converting the N subband sample signals of the ith set of signals into N converted vectors based on a DCT, wherein if i is an odd number, the (2j−1)th subband sample signal among the N subband sample signals is multiplied by negative one in the DCT module, wherein j is an integer index ranging from 1 to (N/2); and a generating module for generating N pulse code modulation (PCM) signals based on the N converted vectors;

wherein the M sets of signals are in accordance with the MPEG-1 Layer III standard; M is equal to 18, and N is equal to 32, the kth subband sample signal among the 32 subband sample signals of the ith set of signals is represented as x(k−1); k is an integer index ranging from 1 to 32, and the DCT module processes x(p), x(31−p), x(15−p), and x(16+p), wherein p is an integer index ranging from 0 to 7, and the DCT module judges whether i is an odd number, if the judging result is NO, the DCT module calculates four intermediate results (g1(p), g2(p), g3(p), and g4(p)) corresponding to p based on a first set of equations; if the judging result is YES, the DCT module judges whether p is an odd number and then selectively calculates the four intermediate results (g1(p), g2(p), g3(p), and g4(p)) corresponding to p via a second set of equations or a third set of equations according to the judging result about whether p is an odd numbers.

2. The subband synthesis filtering apparatus of claim 1, wherein the DCT module comprises:

a first DCT unit for processing x(p), x(31−p), x(15−p), and x(16+p), the first DCT unit further comprises:

a first judging module for judging whether i is an odd number; and a calculating module operated by the first judging module, if the judging result of the first judging module is NO, the calculating module calculating the four intermediate results (g1(p), g2(p), g3(p), and g4(p)) corresponding to p based on the first set of equations:

$$g1(p) = x(p) + x(31-p) + x(15-p) + x(16+p)$$

$$g2(p) = \left(\frac{1}{2}C_{32}^{(2p+1)}\right)[x(p) + x(31-p) - x(15-p) - x(16+p)]$$

$$g3(p) = \left(\frac{1}{2}C_{64}^{(2p+1)}\right)[x(p) - x(31-p)] + \left(\frac{1}{2}C_{64}^{(31-2p)}\right)[x(15-p) - x(16+p)]$$

-continued $$g4(p) = \left(\frac{1}{2}C_{32}^{(2p+1)}\right)$$

$$\left\{\left(\frac{1}{2}C_{64}^{(2p+1)}\right)[x(p) - x(31-p)] - \left(\frac{1}{2}C_{64}^{(31-2p)}\right)[x(15-p) - x(16+p)]\right\},$$

wherein $C_{64}^{(2p+1)}$ is equal to $\cos\left(\frac{2p+1}{64}\pi\right)$, $C_{64}^{(31-2p)}$ is equal to $\cos\left(\frac{31-2p}{64}\pi\right)$, $C_{32}^{(2p+1)}$ is equal to $\cos\left(\frac{2p+1}{32}\pi\right)$; and a second DCT unit for generating the 32 converted vectors based on the intermediate results calculated by the calculating module.

3. The subband synthesis filtering apparatus of claim 1, wherein the DCT module comprises:

a first DCT unit for processing x(p), x(31−p), x(15−p), and x(16+p), the first DCT unit further comprises:

a first judging module for judging whether i is an odd number;

a second judging module operated by the first judging module, if the judging result of the first judging module is YES, the second judging module judging whether p is an odd number; and a calculating module operated by the second judging module, if the judging result of the second judging module is NO, the calculating module calculating the four intermediate results (g1(p), g2(p), g3(p), and g4(p)) corresponding to p based on the second set of equations:

$$g1(p) = x(p) - x(31-p) - x(15-p) + x(16+p)$$

$$g2(p) = \left(\frac{1}{2}C_{32}^{(2p+1)}\right)[x(p) - x(31-p) + x(15-p) - x(16+p)]$$

$$g3(p) = \left(\frac{1}{2}C_{64}^{(2p+1)}\right)[x(p) + x(31-p)] - \left(\frac{1}{2}C_{64}^{(31-2p)}\right)[x(15-p) + x(16+p)]$$

$$g4(p) = \left(\frac{1}{2}C_{32}^{(2p+1)}\right)$$

$$\left\{\left(\frac{1}{2}C_{64}^{(2p+1)}\right)[x(p) + x(31-p)] + \left(\frac{1}{2}C_{64}^{(31-2p)}\right)[x(15-p) + x(16+p)]\right\},$$

wherein $C_{64}^{(2p+1)}$ is equal to $\cos\left(\frac{2p+1}{64}\pi\right)$, $C_{64}^{(31-2p)}$ is equal to $\cos\left(\frac{31-2p}{64}\pi\right)$, $C_{32}^{(2p+1)}$ is equal to $\cos\left(\frac{2p+1}{32}\pi\right)$; and a second DCT unit for generating the 32 converted vectors based on the intermediate results calculated by the calculating module.

4. The subband synthesis filtering apparatus of claim 1, wherein the DCT module comprises:

a first DCT unit for processing x(p), x(31−p), x(15−p), and x(16+p), the first DCT unit further comprises:

a first judging module for judging whether i is an odd number;

a second judging module operated by the first judging module, if the judging result of the first judging module is YES, the second judging module judging whether p is an odd number; and a calculating module operated by the second judging module, if the judging result of the second judging module is YES, the calculating module calculating the four intermediate results (g1(p), g2(p), g3(p), and g4(p)) corresponding to p based on the third set of equations:

$$g1(p) = -x(p) + x(31-p) + x(15-p) - x(16+p)$$

$$g2(p) = \left(\frac{1}{2}C_{32}^{(2p+1)}\right)[-x(p) + x(31-p) - x(15-p) + x(16+p)]$$

$$g3(p) = \left(\frac{1}{2}C_{64}^{(2p+1)}\right)[-x(p) - x(31-p)] + \left(\frac{1}{2}C_{64}^{(31-2p)}\right)[x(15-p) + x(16+p)]$$

$$g4(p) = \left(\frac{1}{2}C_{32}^{(2p+1)}\right)\left\{\left(\frac{1}{2}C_{64}^{(2p+1)}\right)[-x(p) - x(31-p)] - \left(\frac{1}{2}C_{64}^{(31-2p)}\right)[x(15-p) + x(16+p)]\right\},$$

wherein $C_{64}^{(2p+1)}$ is equal to $\cos\left(\frac{2p+1}{64}\pi\right)$, $C_{64}^{(31-2p)}$ is equal to $\cos\left(\frac{31-2p}{64}\pi\right)$, $C_{32}^{(2p+1)}$ is equal to $\cos\left(\frac{2p+1}{32}\pi\right)$; and a second DCT unit for generating the 32 converted vectors based on the intermediate results calculated by the calculating module.

5. A process of operating a subband synthesis filtering apparatus for M sets of signals which each comprises N subband sample signals, M and N being both positive integers, said process comprising the steps of:

the subband synthesis filtering apparatus processing the ith set of signals among the M sets of signals, wherein i is an integer index ranging from 0 to (M−1), and when the ith set of signals is processed, the following steps are performed:

(a) based on the N subband sample signals of the ith set of signals and a discrete cosine transform (DCT), the subband synthesis filtering apparatus generating N converted vectors, wherein if i is an odd number, the (2j−1) th subband sample signal among the N subband sample signals is multiplied by negative one during the process of generating the N converted vectors, wherein j is an integer index ranging from 1 to (N/2); and (b) based on the N converted vectors, the subband synthesis filtering apparatus generating N pulse code modulation (PCM) signals;

wherein the M sets of signals are in accordance with the MPEG-1 Layer III standard; M is equal to 18, and N is equal to 32, the kth subband sample signal among the 32 subband sample signals of the ith set of signals is represented as x(k−1); k is an integer index ranging from 1 to 32, and the subband synthesis filtering apparatus processes x(p), x(31−p), x(15−p), and x(16+p), wherein p is an integer index ranging from 0 to 7, and the subband synthesis filtering apparatus judges whether i is an odd number, if the judging result is NO, the subband synthesis filtering apparatus calculates four intermediate results (g1(p), g2(p), g3(p), and g4(p)) corresponding to p based on a first set of equations; if the judging result is YES, the subband synthesis filtering apparatus judges whether p is an odd number and then selectively calculates the four intermediate results (g1(p), g2(p), g3(p), and g4(p)) corresponding to p via a second set of equations or a third set of equations according to the judging result about whether p is an odd number.

6. The process of claim 5, wherein (a1) processing x(p), x(31−p), x(15−p), and x(16+p), wherein p is an integer index ranging from 0 to 7, and performing the following sub-steps for x(p), x(31−p), x(15−p), and x(16+p):

(a1-1) judging whether i is an odd number, if NO, performing step (a1-2); and (a1-2) calculating four intermediate results (g1(p), g2(p), g3(p), and g4(p)) corresponding to p according to the following equations: the first set of equations is:

$$g1(p) = x(p) + x(31-p) + x(15-p) + x(16+p)$$

$$g2(p) = \left(\frac{1}{2}C_{32}^{(2p+1)}\right)[x(p) + x(31-p) - x(15-p) - x(16+p)]$$

$$g3(p) = \left(\frac{1}{2}C_{64}^{(2p+1)}\right)[x(p) - x(31-p)] + \left(\frac{1}{2}C_{64}^{(31-2p)}\right)[x(15-p) - x(16+p)]$$

$$g4(p) = \left(\frac{1}{2}C_{32}^{(2p+1)}\right)\left\{\left(\frac{1}{2}C_{64}^{(2p+1)}\right)[x(p) - x(31-p)] - \left(\frac{1}{2}C_{64}^{(31-2p)}\right)[x(15-p) - x(16+p)]\right\},$$

wherein $C_{64}^{(2p+1)}$ is equal to $\cos\left(\frac{2p+1}{64}\pi\right)$, $C_{64}^{(31-2p)}$ is equal to $\cos\left(\frac{31-2p}{64}\pi\right)$, $C_{32}^{(2p+1)}$ is equal to $\cos\left(\frac{2p+1}{32}\pi\right)$; and and the subband synthesis filtering apparatus generates the 32 converted vectors based on the intermediate results and a DCT;

(a2) based on the intermediate results calculated in the step (a1) and a DCT, generating the 32 converted vectors.

7. The process of claim 5, wherein (a1) processing x(p), x(31−p), x(15−p), and x(16+p), wherein p is an integer index ranging from 0 to 7, and performing the following sub-steps for x(p), x(31−p), x(15−p), and x(16+p):

(a1-1) judging whether i is an odd number, if YES, performing step (a1-2);

(a1-2) judging whether p is an odd number, if NO, performing step (a1-3); and (a1-3) calculating four intermediate results (g1(p), g2(p), g3(p), and g4(p)) corresponding to p according to the following equations: if the judging result about whether p is an odd number is NO, the subband synthesis filtering apparatus calculates the four intermediate results (g1(p), g2(p), g3(p), and g4(p)) corresponding to p via the second set of equations:

$$g1(p) = x(p) - x(31-p) - x(15-p) + x(16+p)$$

$$g2(p) = \left(\frac{1}{2}C_{32}^{(2p+1)}\right)[x(p) - x(31-p) + x(15-p) - x(16+p)]$$

$$g3(p) = \left(\frac{1}{2}C_{64}^{(2p+1)}\right)[x(p) + x(31-p)] - \left(\frac{1}{2}C_{64}^{(31-2p)}\right)[x(15-p) + x(16+p)]$$

$$g4(p) = \left(\frac{1}{2}C_{32}^{(2p+1)}\right)\left\{\left(\frac{1}{2}C_{64}^{(2p+1)}\right)[x(p) + x(31-p)] + \left(\frac{1}{2}C_{64}^{(31-2p)}\right)[x(15-p) + x(16+p)]\right\},$$

-continued wherein $C_{64}^{(2p+1)}$ is equal to $\cos\left(\frac{2p+1}{64}\pi\right)$, $C_{64}^{(31-2p)}$ is equal to $\cos\left(\frac{31-2p}{64}\pi\right)$, $C_{32}^{(2p+1)}$ is equal to $\cos\left(\frac{2p+1}{32}\pi\right)$; and and the subband synthesis filtering apparatus generates the 32 converted vectors based on the intermediate results and a DCT;

(a2) based on the intermediate results calculated in the step (a1) and a DCT, generating the 32 converted vectors.

8. The process of claim 5, wherein (a1) processing x(p), x(31−p), x(15−p), and x(16+p), wherein p is an integer index ranging from 0 to 7, and performing the following sub-steps for x(p), x(31−p), x(15−p), and x(16+p):

(a1-1) judging whether i is an odd number, if YES, performing step (a1-2);

(a1-2) judging whether p is an odd number, if YES, performing step (a1-3); and (a1-3) calculating four intermediate results (g1(p), g2(p), g3(p), and g4(p)) corresponding to p according to the following equations: if the judging result about whether p is an odd number is YES, the subband synthesis filtering apparatus calculates the four intermediate results (g1(p), g2(p), g3(p), and g4(p)) corresponding to p via the third set of equations:

$$g1(p) = -x(p) + x(31-p) + x(15-p) - x(16+p)$$

$$g2(p) = \left(\frac{1}{2}C_{32}^{(2p+1)}\right)[-x(p) + x(31-p) - x(15-p) + x(16+p)]$$

$$g3(p) = \left(\frac{1}{2}C_{64}^{(2p+1)}\right)[-x(p) - x(31-p)] + \left(\frac{1}{2}C_{64}^{(31-2p)}\right)[x(15-p) + x(16+p)]$$

$$g4(p) = \left(\frac{1}{2}C_{32}^{(2p+1)}\right)\left\{\left(\frac{1}{2}C_{64}^{(2p+1)}\right)[-x(p) - x(31-p)] - \left(\frac{1}{2}C_{64}^{(31-2p)}\right)[x(15-p) + x(16+p)]\right\},$$

wherein $C_{64}^{(2p+1)}$ is equal to $\cos\left(\frac{2p+1}{64}\pi\right)$, $C_{64}^{(31-2p)}$ is equal to $\cos\left(\frac{31-2p}{64}\pi\right)$, $C_{32}^{(2p+1)}$ is equal to $\cos\left(\frac{2p+1}{32}\pi\right)$; and and the subband synthesis filtering apparatus generates the 32 converted vectors based on the intermediate results and a DCT;

(a2) based on the intermediate results calculated in the step (a1) and a DCT, generating the 32 converted vectors.

* * * * *

UNITED STATES PATENT AND TRADEMARK OFFICE

CERTIFICATE OF CORRECTION

PATENT NO. : 7,636,660 B2
APPLICATION NO. : 11/454402
DATED : December 22, 2009
INVENTOR(S) : Hung et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 619 days.

Signed and Sealed this

Ninth Day of November, 2010

David J. Kappos

David J. Kappos
*Director of the United States Patent and Trademark Office*